US005456328A

United States Patent [19]

Saxman

[11] Patent Number: 5,456,328

[45] **Date of Patent: * Oct. 10, 1995**

[54] DRILL BIT WITH IMPROVED ROLLING CUTTER TOOTH PATTERN

[75] Inventor: William C. Saxman, Dallas, Tex.

[73] Assignee: Dresser Industries, Inc., Dallas, Tex.

[ * ] Notice: The portion of the term of this patent subsequent to Jul. 4, 2012 has been disclaimed.

[21] Appl. No.: 188,481

[22] Filed: Jan. 28, 1994

Related U.S. Application Data

[63] Continuation-in-part of Ser. No. 178,568, Jan. 7, 1994.

[51] Int. Cl.[6] ..... E21B 10/16

[52] U.S. Cl. ..... 175/376; 175/377; 175/378

[58] Field of Search ..... 175/378, 376, 175/377, 374

[56] References Cited

U.S. PATENT DOCUMENTS

| | | | |
|---|---|---|---|
| 1,602,794 | 10/1926 | Erwin et al. . | |
| 1,905,860 | 4/1933 | Hammer . | |
| 1,906,427 | 5/1933 | Sievers et al. . | |
| 2,122,759 | 7/1938 | Scott | 175/376 X |
| 2,160,852 | 6/1939 | Gauthey | 175/364 X |
| 2,201,570 | 5/1940 | Zublin | 175/358 X |
| 2,248,339 | 7/1941 | Catland | 175/378 |
| 2,626,128 | 1/1953 | Boice | 175/376 X |
| 2,749,093 | 6/1956 | Peter | 175/376 X |
| 3,385,385 | 5/1968 | Kucera et al. | 175/378 X |
| 3,389,760 | 6/1968 | Morris . | |
| 4,056,153 | 11/1977 | Miglierini | 175/376 |
| 4,334,586 | 6/1982 | Schumacher | 175/374 |
| 4,393,949 | 7/1983 | Peterson | 175/377 |
| 4,420,050 | 12/1983 | Jones | 175/374 |

OTHER PUBLICATIONS

Security Division, Dresser Industries, Inc., "Serpentine* Design No. 6 S8–Sb Cutter For Security Custom Hole Openers", *Field Technical Bulletin,* Jan. 1993.

Security Division, Dresser Industries, Inc., "Drilling Tools, Standard Hole Openers" #3364.

Security Division, Dresser Industries, Inc., "Drilling Tools, Custom Hole Openers" #3365.

*Primary Examiner*—Hoang C. Dang

*Attorney, Agent, or Firm*—Baker & Botts

[57] ABSTRACT

A drill bit includes a rolling cutter having a plurality of closed-end circumferential rows of teeth protruding from the body of the cutter. At least one of the rows of teeth lies along a path defined either by multiple helical segments or a canted planar periphery.

7 Claims, 6 Drawing Sheets

DRILL BIT WITH IMPROVED ROLLING CUTTER TOOTH PATTERN

CROSS-REFERENCE FOR RELATED APPLICATION

This application is a continuation-in-part of U.S. application Ser. No. 08/178,568, filed Jan. 7, 1994 by William C. Saxman and entitled "DRILL BIT WITH IMPROVED ROLLING CUTTER TOOTH PATTERN" pending.

TECHNICAL FIELD OF THE INVENTION

This invention relates generally to earth boring bits and in particular to the placement pattern of cutting elements on a rolling cutter.

BACKGROUND OF THE INVENTION

When forming a well bore, various forms of earth boring bits are used to cut through the hard material formations in the earth. One type of drill bit utilizes one or more rolling cutters whose outer surfaces include projections such as milled teeth or cutter inserts. Each cutter is mounted to rotate about a supporting shaft or spindle extending from the drill bit. Typically, the spindle axis is spaced radially from and inclined with respect to the rotational axis of the drill. The incline of the spindle axis causes the cutter to both rotate about its rotational axis and roll relative to the borehole bottom as the bit body rotates. As the cutter rolls, the teeth gouge into and pulverize the formation material. As a result, the cutter disintegrates a concentric ring of formation material at the borehole bottom.

U.S. Pat. No. 3,389,760 discloses an early version of the foregoing type of rolling cutter. A rolling cone cutter is supported by and rotates about a load pin, which is supported at its ends by a generally U-shaped support saddle. A number of such saddle and rolling cutter arrangements may be mounted on a single bit body for drilling a large borehole. For disintegrating formation, a multiplicity of small inserts made from cemented tungsten carbide are fitted into holes drilled into each cutter body. These inserts are disposed in overlapping rows so that as the cutter is rolled over the hole bottom, the inserts cut overlapping tracks. As a result, the formation is disintegrated over the full width of a concentric swath defined by the radial length of the cutter with respect to the drill-bit axis. The cutting elements of U.S. Pat. No. 3,389,760 are disposed in a semi-random pattern on a smooth outer surface of the cutter. This pattern causes certain lateral discontinuities in the bottom hole pattern. As a result, the discontinuous succession from one cutting element to another during drill-bit rotation often imparts an abrupt impact force to the drill assembly. Furthermore, the outer surface of the cutter lacks relief grooves, which aid the initial removal via drilling fluid of a disintegrated formation.

U.S. Pat. No. 4,393,949 discloses another prior-art roller cutter, which includes a helical cutting tooth protruding from the cutter body. The helical shape of the tooth functions to cut along the full width of the concentric swath formed by the roller cutter as the bit is rotated. However, the helical path of the tooth is open, i.e., it does not close upon itself. The open-ended helical cutting structure produces a bottom hole pattern resembling a series of skewed or spiraled open-ended grooves. These grooves may subject the lead edge of the cutting tooth to an abrupt load with each revolution of the cutter about its axis.

SUMMARY OF THE INVENTION

The present invention provides cutter teeth arranged on a roller cutter in a novel, single pattern that can be utilized on essentially all of the roller cutters of a bit to avoid the problem of abrupt loading of the cutter teeth. This pattern provides sufficient space for a groove along which drilling fluid can flow to carry away disintegrated formation material.

More particularly, the present invention achieves the foregoing by arranging the cutter teeth in at least one closed-end canted row on the outer surface of the cutter. This row includes a first segment that slants away from a first end of the cutter and toward a second end while progressing in a circumferential direction around the cutter. A second segment joins with the first and slants toward the first end and away from the second end while progressing in the same circumferential direction.

More specifically, a first aspect of the invention resides in said first and second segments being formed in a circumferential path defined on the surface of the cutter by first and second helical curves.

In a second aspect of the invention, both the first and second segments lie in a single plane that forms an oblique angle with the rotational axis of the cutter.

Invention also resides in the novel combination of opposite end rows of cutting teeth concentric to the axis of the cutter body and with one or more canted rows of cutter teeth mounted between the opposite end rows.

The foregoing and other advantages of the present invention will become more apparent from the following description of the best mode for carrying out the invention when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
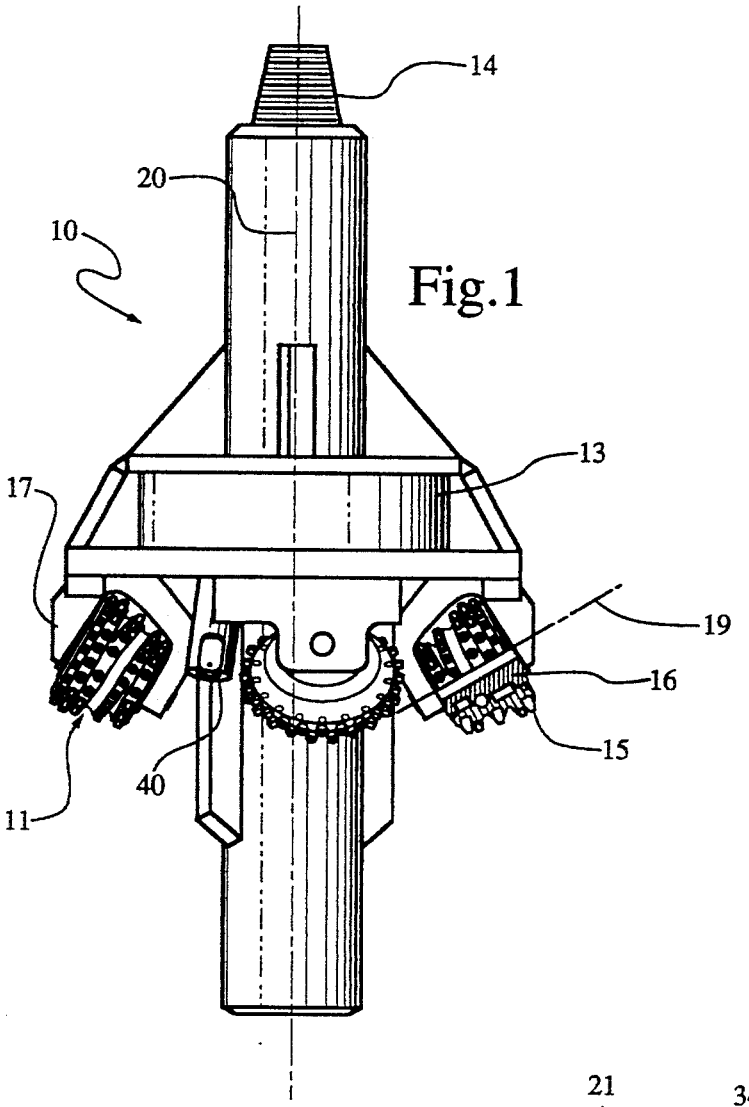
FIG. 1 is an elevational view of a drill bit having mounted thereon a roller cutter embodying the novel features of the first aspect of the present invention.

The preferred embodiment of the present invention and its advantages are best understood by referring to FIGS. 1–7 of the drawings, like numerals being used for like and corresponding parts of the various drawings.

As shown in the drawings for purposes of illustration, the present invention is embodied in a drill bit commonly known as a hole opener 10. In the hole opener, a plurality of rolling cutters 11 are mounted on a bit body 13, which is secured within a drill string in the usual manner by threads 14. Cutters 11 include outwardly projecting teeth 15 and are mounted intermediate the ends of body 13 on angularly spaced spindles 16, which are secured to radially protruding shoulders 17 constructed on body 13. Longitudinal axes 19 of spindles 16 extend in generally radial directions relative to a central axis 20 of body 13. Accordingly, as the drill string rotates hole opener 10, body 13 rotates about its axis 20. The rotation of body 13 causes cutters 11 to rotate about their axes 19. As cutters 11 rotate, their lower sides ride around the periphery of a previously formed hole. Teeth 15 disintegrate the formation around the hole periphery, thus widening the hole.

In accordance with the first aspect of the present invention, teeth 15 are arranged in a unique pattern including at least one closed-end canted row 21 on the surface of cutter 11 to avoid the impact loading problems associated with the row end teeth of prior art cutters. For this purpose, canted row 21 includes a first segment 23 (FIGS. 3A–B, 4A), which slants away from a first end 24 of cutter 11 upon progressing circumferentially and in a counterclockwise direction along the surface of cutter 11 in a path defined by a helical curve from a starting position toward a second end 26 of cutter 11 for a first circumferential distance. A second segment 27 (FIGS. 3C–D) slants away from second end 26 and toward first end 24 in an opposite path defined by a helical curve upon continuing in such circumferential counterclockwise direction a second distance back to the starting point. By virtue of this arrangement, as cutter 11 is rotated about its axis 19, the teeth 15 within canted row 21 disintegrate a wide path of material in the formation being drilled.

Figure 2:
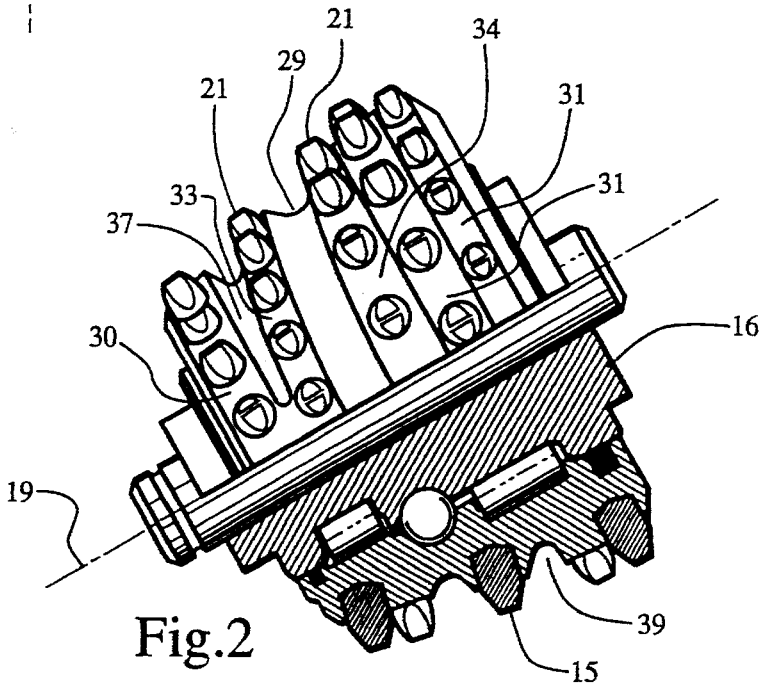
FIG. 2 is an enlarged perspective view of a FIG. 1 roller cutter.
Figure 3A:
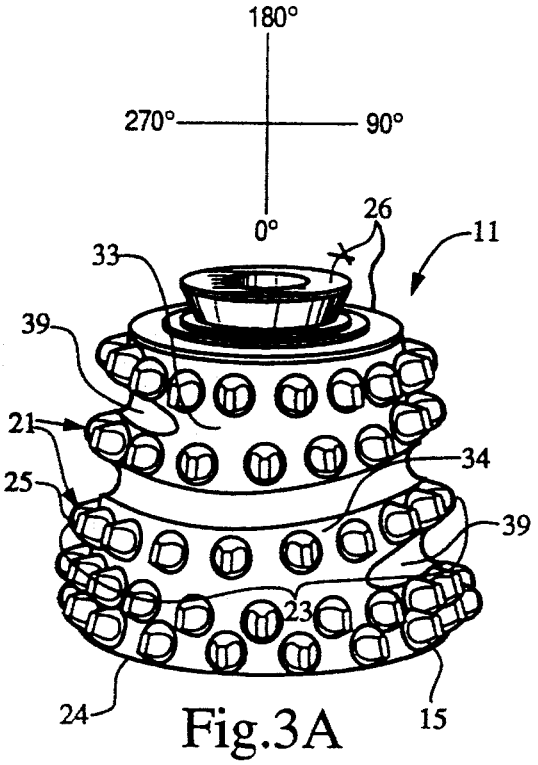
FIG. 3A–D are elevational views of the FIG. 2 roller cutter shown from each of four different sides to more clearly illustrate the surface pattern of cutter teeth placement.
Figure 3B:
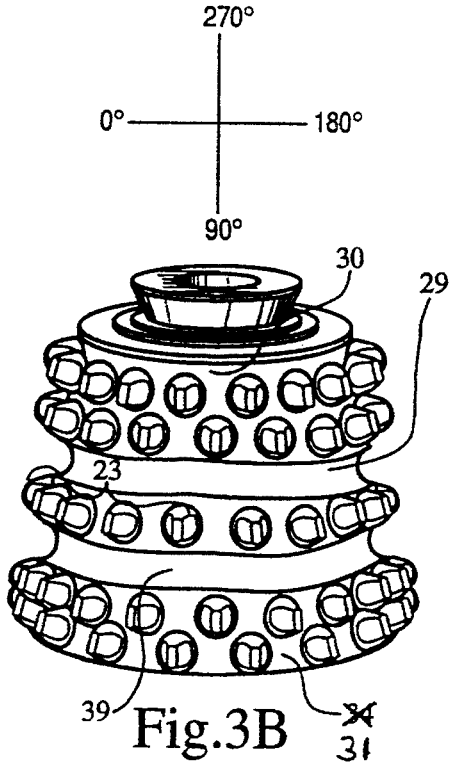
Figure 3C:
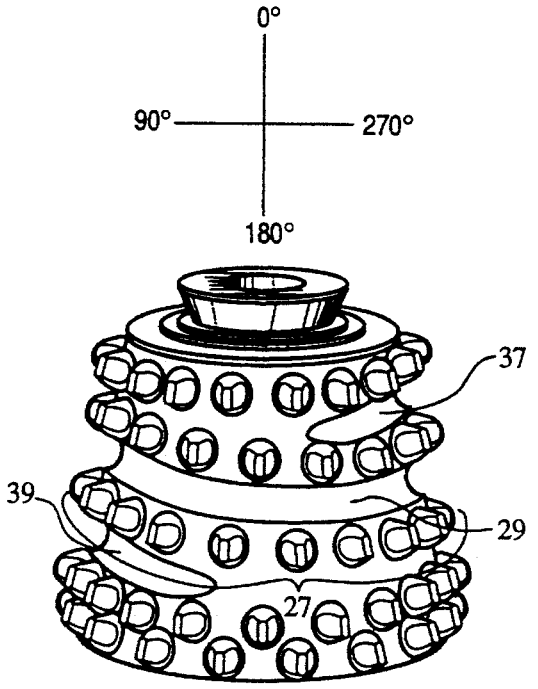
Figure 3D:
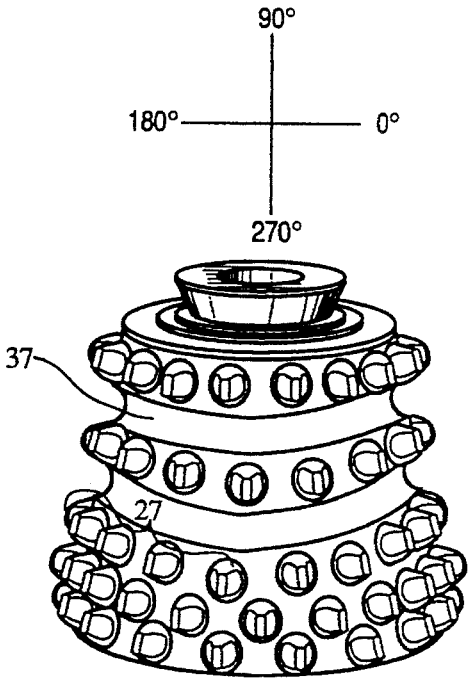

In the present instance, each of the cutters 11 is of a virtually identical configuration. Accordingly, only one of the cutters 11 will be hereinafter described in detail, it being appreciated that such description applies equally well to the other cutters 11 mounted upon body 13 of hole opener 10. As shown in FIG. 2, the overall shape of cutter 11 is generally frustoconical. On the exemplary hole opener, second end 26 of cutter 11 is located nearer central axis 20 of bit 13, and first end 24 is spaced radially farther outwardly of central axis 20. Preferably, the taper between smaller end 26 and larger end 24 is at a cone angle such that the outer surface of cutter 11 matches a natural roll of bit 13 about central axis 20 without undue skidding or sliding of cutter teeth 15 relative to the formation being disintegrated.

The outer surface of cutter 11 includes a circumferentially extending annular groove 29, which is formed within the cutter 11 body and provides a channel for carrying away disintegrated formation material. Also on the outer surface of cutter 11 are lands 30 and 31 extending in a circumferential direction. Adjacent the second end 26 is first circumferential land 30 formed as a single continuous ring. Within land 30 are a plurality of sockets drilled in a radial direction for receiving carbide teeth 15 with a press fit in the usual manner. Adjacent first end 24 of cutter 11 are two similarly formed circumferential lands 31 containing additional carbide teeth 15 mounted within sockets in a similar manner. Both of the lands 30 and 31 adjacent first and second ends 24 and 26 of cutter 11, and the teeth 15 mounted within these lands, are located generally within planes that extend perpendicularly to longitudinal axis 19 of cutter 11. Thus, the teeth 15 within lands 30 and 31 are located within circular rows concentric with axis 19.

Within the space between these circular rows of teeth are the two canted rows 21 of teeth 15. The canted-row lands 33 and 34 are separated by the circumferential relief groove 29 and are disposed on the surface of cutter 11 in substantially a radial direction relative to axis 19.

Figure 4A:
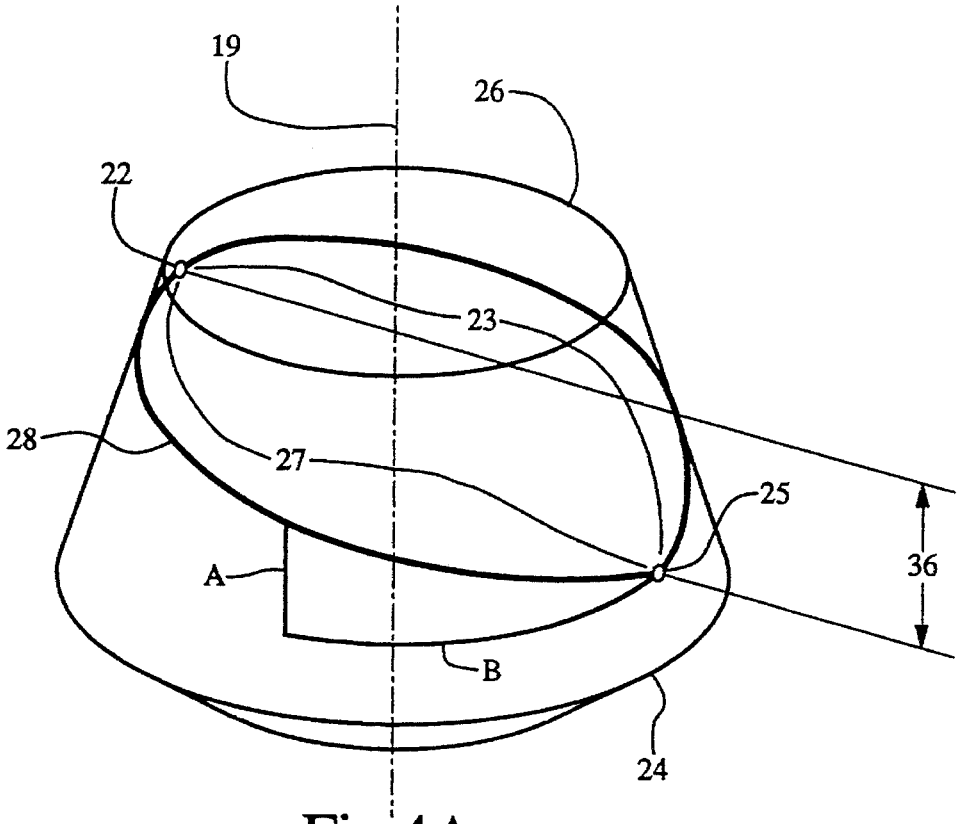
FIG. 4A shows the helical path along which lies a canted row of the FIG. 2 cutter.

Referring to FIG. 4A, the canted row 21 closest to smaller end 26 of cutter 11 lies along a closed-end circumferential path 28, which is defined on the outside surface of cutter 11 by opposite first and second helical curves. The circumferential path thus formed includes segment 23, which beginning at a starting point 25, is closest to larger end 24 of cutter 11 and extends along a portion of path 28 defined by one helical curve toward smaller end 26 upon progressing in a counterclockwise direction along the surface of cutter 11 until reaching a second point 22 that is closest to smaller end 26. Thereafter, continuing in a counterclockwise direction, path 28 slants away from smaller end 26 and toward larger end 24 back to starting point 25 along a segment 27 that is defined by an opposite helical curve. The difference in height between starting point 25 and second point 22 defines a lateral displacement 36, which is determined by the helical slope (discussed below) of segments 23 and 27 and the size of cutter 11. In one embodiment of cutter 11, lateral displacement 36 is substantially one inch.

The slope of a helical segment is defined as the length of the segment's first projection (A) in a plane parallel to rotational axis 19 divided by the segment's second projection (B) in a plane perpendicular to axis 19 and tangent to a segment end point. For example, the slope of helical segment 27 is A/B, where A is the perpendicular distance from the end of arc B to segment 27, and B is the length of arc B.

Figure 4B:
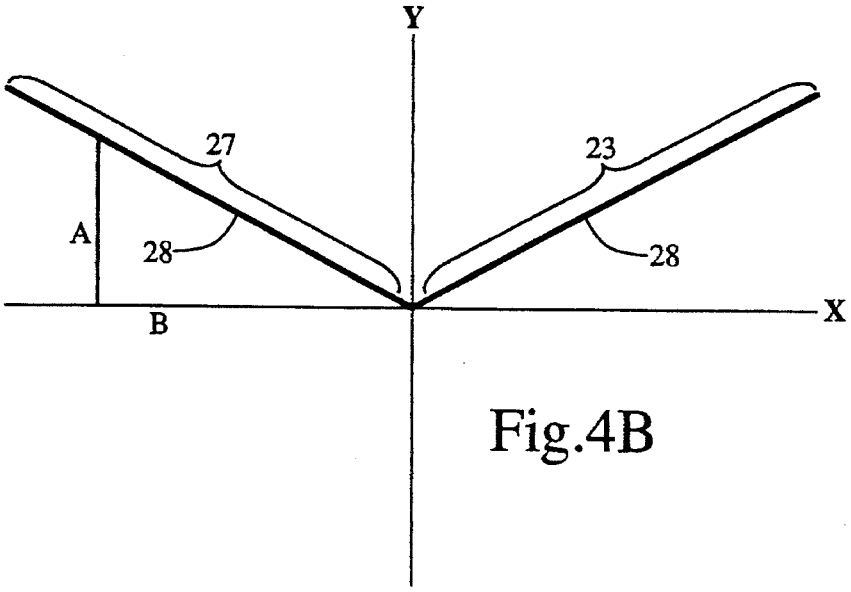
FIG. 4B is a two-dimensional representation of the helical path of FIG. 4A.

Referring to FIG. 4B, helical segments 23 and 27 are "unwound" and plotted on a two-dimensional graph. In this illustration, the helical slope is revealed as simply the slope of a straight line. The slope of segment 27 is −A/B, and the slope of segment 23 is +A/B. Thus, each segment 23 and 27 is merely a straight line wrapped around the outer surface of cutter 11 while maintaining its linear slope.

Although FIG. 4A shows helical path 28 consisting of two opposite helical segments 23 and 27, path 28 may include three or more helical segments having slopes of different magnitudes and directions.

The two canted rows 21 of teeth 15, which are shown on the exemplary cutter extending parallel to each other, are defined in substantially the same manner with the circumferential relief groove 29 formed therebetween. Herein, the latter is defined in a similar manner as that of canted rows 21 by milling opposite first and second helical grooves in the surface of cutter 11 generally centered between canted rows 21. Additional crescent-shaped partial circumferential grooves 37 and 39 extend between canted rows 21 and the adjacent circular lands 30 and 31. In the exemplary hole opener, relief grooves 29, 37 and 39 are positioned relative to fluid injecting nozzles 40 (FIG. 1) formed in bit body 13 to help circulate disintegrated formation material away from the face of cutter 11.

Figure 5:
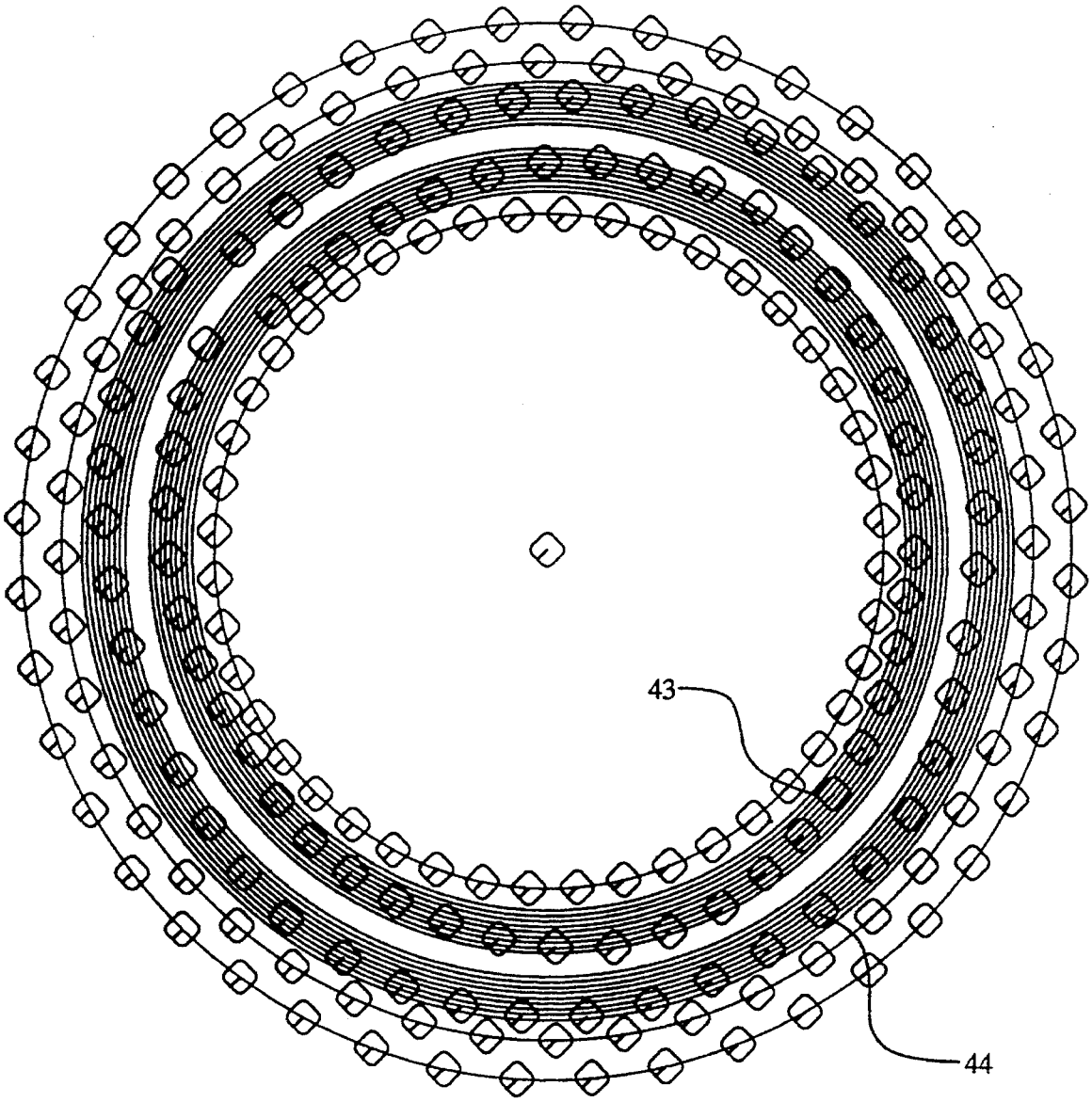
FIG. 5 is a bottom hole pattern of teeth contact points produced by one FIG. 2 cutter and one drill-bit revolution.

FIG. 5 depicts a representative bottom hole pattern, which would be generated with a single cutter 11 as a result of a single revolution of bit 13 about its axis 20. The individual circular points represent the contact points made by each of the insert teeth 15 within each row upon contact with the bottom hole surface. Two areas 43 and 44 include the concentric impact paths of the centers of teeth 15 within canted rows 21. These paths form with repeated revolutions of bit 13. In this embodiment, the impact points of the inserts 15 that form the outer path of area 43 and the inner path of area 44 overlap to disintegrate material between areas 43 and 44. However, other embodiments may lack this overlap.

It will be appreciated that the exemplary hole opener 10 has a plurality of cutters 11 that are located to cut over the same paths around the borehole that is being enlarged. In rotating the bit through a single revolution, a cutter 11 will make several rotations about its central axis 19 in traversing the entire circumference of the hole that is being opened. In the shaded area 43, the individual contact points for teeth 15 in the canted row 21 nearest to end 26 are indicated by the letters A–Q. Because of the slanted circumferential positions of teeth 15 on the surface of cutter 11, the radial positions of the contact points vary relative to central axis 20 upon progressing circumferentially around the hole bottom. Thus, the impact points from the canted row teeth follow a sinusoidal or serpentine pattern through path 43 around axis 20.

Advantageously, this continuous translating action of the cutting elements can be used to effectively disintegrate the entire width of the path of formation material represented by areas 43 and 44 and the area therebetween. Preferably, this is accomplished by choosing the circumference of cutter 11 to equal a distance other than one that is an integral fraction (a fraction having "1" as the numerator and an integer as the denominator) of the bore hole circumference. That is, for one revolution of bit 13 about axis 20, cutter 11 should experience a nonintegral number of revolutions about axis 19. As a result, with successive revolutions of bit 13, the individual inserts impact the hole bottom at different points.

Figure 6:
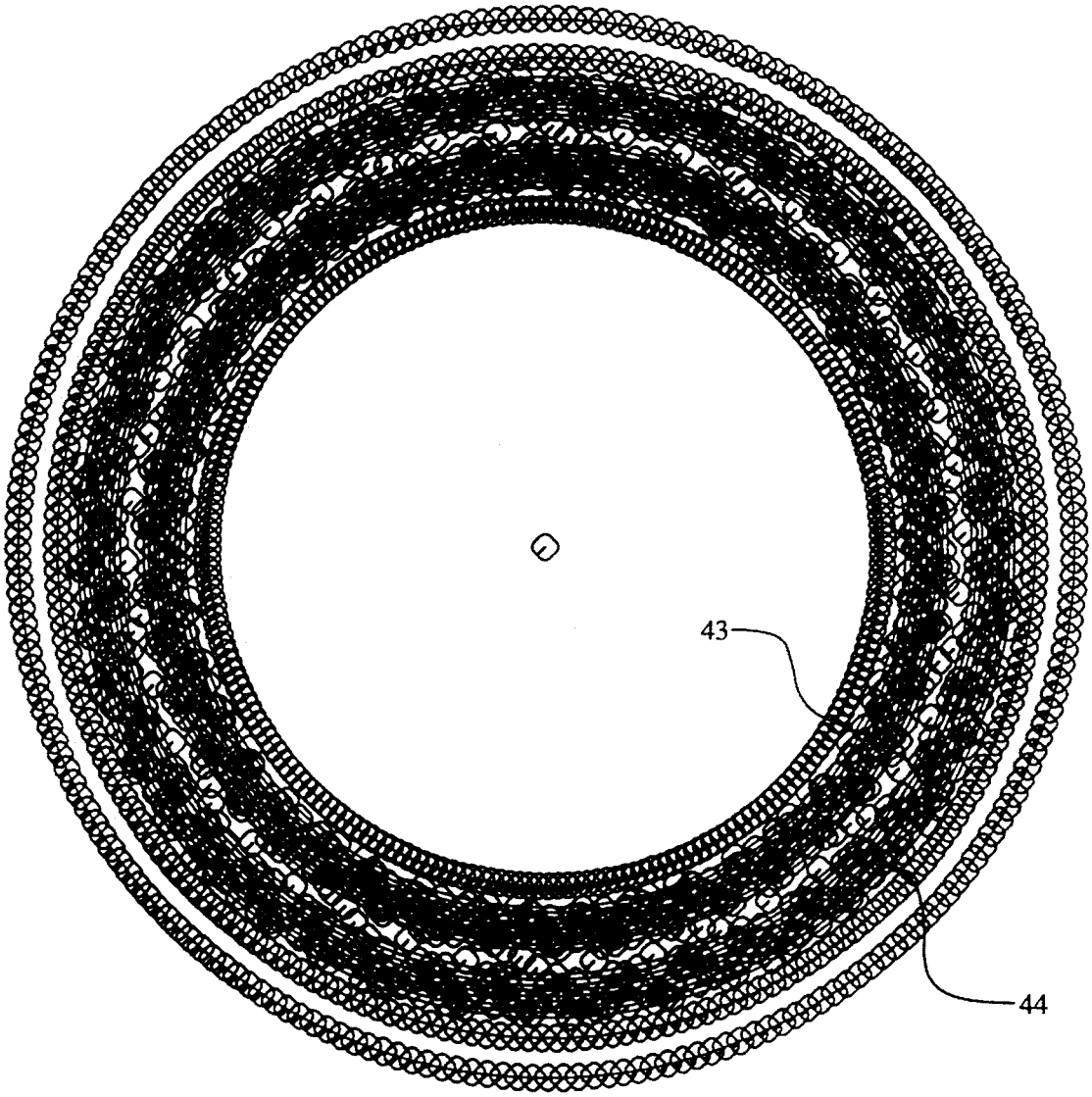
FIG. 6 is a bottom hole pattern of teeth contact points produced by one FIG. 2 cutter and multiple drill-bit revolutions.

FIG. 6 illustrates this result showing the contact points for multiple revolutions of the bit body. Moreover, because the row of teeth is closed-ended, it is not subjected to any excessive impact loading, and the indentations produced in the bottom-hole pattern are relatively harmonic in nature.

By virtue of the foregoing described novel pattern for arranging the cutting teeth 15 of a roller cutter 11 on the surface of the cutter, overall drilling efficiency is improved achieving an effectively random yet controlled disintegration of a wide path of formation while also providing for easy and effective removal of the disintegrated material away from the action of the drill bit.

Figure 7:
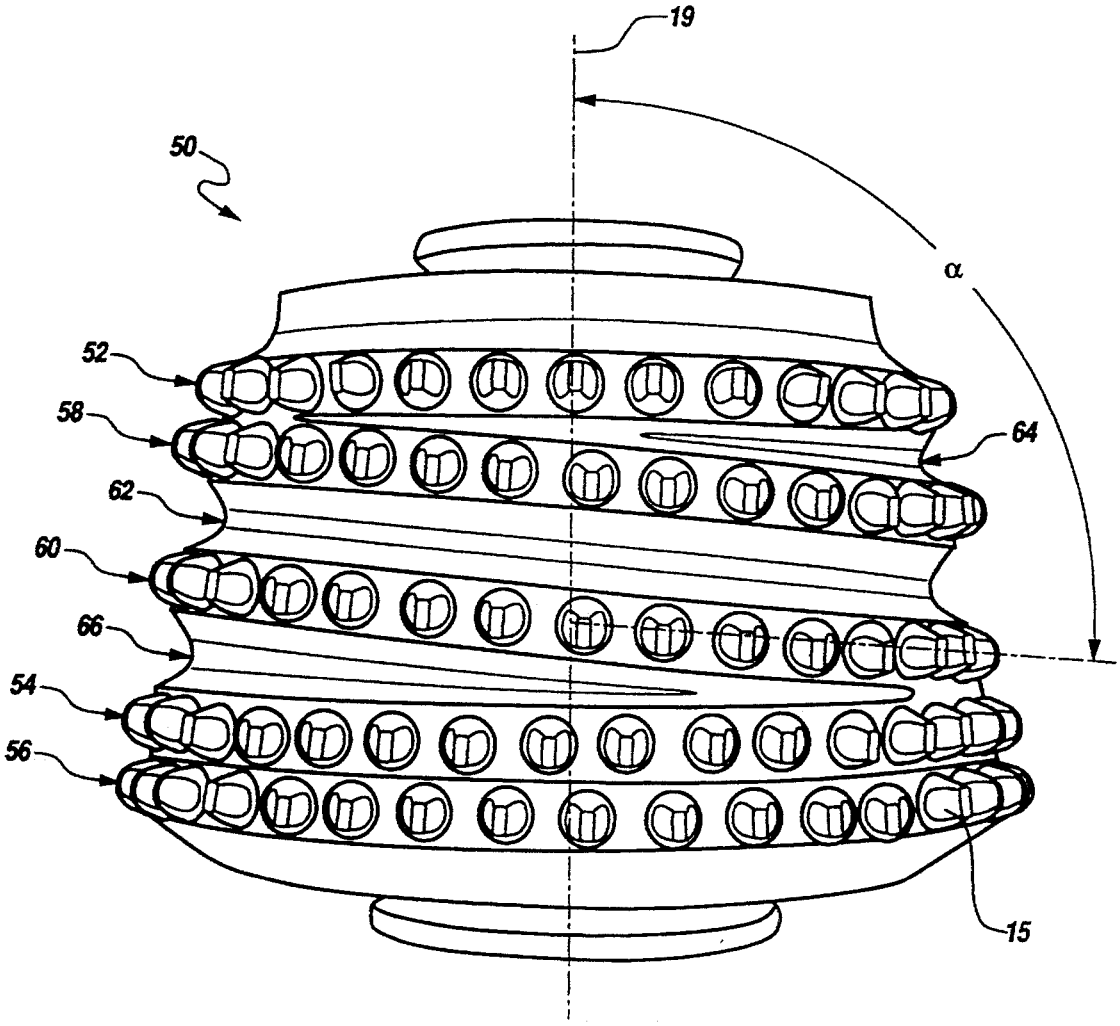
FIG. 7 is a side view of an alternative roller cutter embodying the novel features of the second aspect of the present invention.

FIG. 7 is an alternative cutter 50 that provides advantages similar to those provided by cutter 11. Like cutter 11, cutter 50 is frustoconical in shape and rotates about spindle 16 (FIG. 1) as drill bit 13 rotates. Cutter 50 includes on its outside surface three circumferential rows 52, 54, and 56 of teeth 15. Each row 52, 54, and 56 lies in a plane perpendicular to rotational axis 19. Between rows 52 and 54 lie two canted circumferential rows 58 and 60 of teeth 15. Rows 58 and 60 each lie in a plane that makes an oblique angle $\alpha$ with rotational axis 19. A circumferential relief groove 62 is milled into the outer surface between rows 58 and 60. Two partial circumferential relief grooves 64 and 66 are milled into the outer surface between rows 52 and 58 and rows 60 and 54.

Although the present invention and its advantages have been described in detail, it should be understood that various changes, substitutions and alterations can be made therein without departing from the spirit and scope of the invention as defined by the appended claims. For example, teeth 15 in canted rows 21, 58, or 60 may be spaced other than equidistantly.

What is claimed is:

1. A roller cutter for rotation about a spindle of a drill bit, said cutter comprising:

a cutter body having a generally frustoconical shape with a rotational axis said cutter body having a first end, a second end, and a reference plane perpendicular to said rotational axis;

an inner cavity concentric with said rotational axis for receiving said spindle;

an outer surface having a circumference around said rotational axis;

a circular row of teeth disposed on said outer surface at said first end of said cutter body and another circular row of teeth disposed on said outer surface at said second end of said cutter body;

a first set of teeth disposed on said outer surface in a first closed path canting with respect to said reference plane;

said first closed path having a starting point on said outer surface corresponding with the closest point on said first closed path relative to said first end;

a second set of teeth disposed on said outer surface in a second closed path canting with respect to said reference plane;

a first relief groove disposed on said outer surface disposed between and parallel with said first and second closed paths;

said relief groove have approximately the same relationship with respect to said reference plane as said first closed path and said second closed path; and said first closed path lies in a first plane and said second closed path lies in a second plane parallel to said first plane.

2. The roller cutter of claim 1 further comprising a second relief groove and a third relief groove partially disposed respectively on said outer surface between said respective circular rows of teeth and one of said sets of teeth canting with respect to said reference plane.

3. A drill bit having a bit body rotatable about a central axis comprising:

a number of spindles connected to said bit body with each spindle having a respective longitudinal axis extending radially from said central axis;

a roller cutter mounted on each of said spindles to rotate about said respective longitudinal axis;

each of said roller cutters having a cutter body with a substantially frustoconical configuration and an outer surface formed on said cutter body generally concentric with said respective longitudinal axis;

each of said roller cutters having a first end and a second end;

a first relief groove formed in said outer surface and extending partially along a slanted path from said first end to said second end;

at least a first circular row of teeth located adjacent to said first end of each roller cutter and concentric with said respective longitudinal axis;

at least a second circular row of teeth located adjacent to said second end of each roller cutter and concentric with said respective longitudinal axis;

at least a third closed-end row of teeth disposed on said outer surface of said cutter body extending in substantially a radial direction defined in part by a helical curve having a helical slope between said first circular row of teeth at said first end of said cutter body and said second circular row of teeth at said second end of said cutter body;

a fourth closed-end row of teeth disposed on said outer surface on said cutter body extending in substantially a radial direction defined in part by a helical curve having a helical slope between said first circular row of teeth at said first end of said cutter body and said second circular row of teeth at said second end of said cutter body;

said third closed-end row of teeth and said fourth closed-end row of teeth extending substantially parallel with each other between said first circular row of teeth and said second circular row of teeth; and said first relief groove disposed between said third closed-end row of teeth and said fourth closed-end row of teeth and extending substantially parallel with said third closed-end row of teeth and said fourth closed-end row of teeth.

4. The drill bit of claim 3 wherein said third closed-end row of teeth on each of said roller cutters further comprises:

a first segment having a partially helical slope which slants from said first end of said cutter body towards said second end of said cutter body;

a second segment joining with said first segment on said outer surface of said cutter body adjacent said second circular row of teeth at said second end of said cutter body;

said second segment having a partially helical slope which slants from said second end of said cutter body towards said first end of said cutter body; and said first segment joining with said second segment on said outer surface of said cutter body adjacent said first circular row of teeth at said first end of said cutter body in a direction 180° from said joining of said second segment and said first segment at said second end.

5. The drill bit of claim 3 wherein each of said roller cutters further comprises:

said fourth closed-end row of teeth having a first segment and a second segment;

said first segment having a partially helical slope which slants from said first end of said cutter body towards said second end of said cutter body;

said second segment joining with said first segment on said outer surface of said cutter body adjacent to said second circular row of teeth at said second end of said cutter body; and said second segment having a partially helical slope which slants from said second end of said cutter body towards said first end of said cutter body.

6. The drill bit of claim 3 further comprising:

a second partially circumferential relief groove formed in part between said first circular row of teeth and said third closed-end row of teeth; and a third partially circumferential relief groove formed in part between said second circular row of teeth and said fourth closed-end row of teeth.

7. A drill bit having a bit body rotatable about a central axis comprising:

a number of spindles connected to said bit body with each spindle having a longitudinal axis extending radially from said central axis;

a number of roller cutters mounted on each of said spindles to rotate about said respective longitudinal axis;

each of said roller cutters having a cutter body with a substantially frustoconical configuration and an outer surface formed on said cutter body concentric with said respective longitudinal axis;

each roller cutter having a first end and a second end;

at least a first circular row of teeth located adjacent to said first end and concentric with said respective longitudinal axis;

at least a second circular row of teeth located adjacent to said second end and concentric with said respective longitudinal axis;

at least a third closed-end row of teeth disposed on said outer surface of said cutter body extending in substantially a radial direction defined in part by a helical curve having a helical slope between said first circular row of teeth at said first end of said cutter body and said second circular row of teeth at said second end of said cutter body;

a fourth closed-end row of teeth disposed on said outer surface on said cutter body extending in substantially a radial direction defined in part by a helical curve having a helical slope between said first circular row of teeth at said first end of said cutter body and said second circular row of teeth at said second end of said cutter body;

said third closed-end row of teeth and said fourth closed-end row of teeth extending substantially parallel with each other between said first circular row of teeth and said second circular row of teeth;

a relief groove formed between said third closed-end row of teeth and said fourth closed-end row of teeth and extending substantially parallel with said third closed-end row of teeth and said fourth closed-end row of teeth;

each roller cutter having the same pattern of teeth disposed on said outer surface of said respective cutter body; and said first circular row of teeth, said second circular row of teeth, and said third and fourth dosed-end rows of teeth cooperating with each other to avoid problems with abrupt loading from one tooth to the next tooth during rotation of the drill bit.

* * * * *